US010433038B2

(12) United States Patent
Su et al.

(10) Patent No.: US 10,433,038 B2
(45) Date of Patent: Oct. 1, 2019

(54) LOUDSPEAKER MODULE

(71) Applicant: Goertek Inc., Weifang, Shangdong Province (CN)

(72) Inventors: Tao Su, Weifang (CN); Jun Zhang, Weifang (CN); Chengfei Zhang, Weifang (CN)

(73) Assignee: GOERTEK, INC., Weifang, Shandong (CN)

( * ) Notice: Subject to any disclaimer, the term of this patent is extended or adjusted under 35 U.S.C. 154(b) by 0 days.

(21) Appl. No.: 15/577,169

(22) PCT Filed: Nov. 13, 2015

(86) PCT No.: PCT/CN2015/094517
§ 371 (c)(1),
(2) Date: Nov. 27, 2017

(87) PCT Pub. No.: WO2016/206286
PCT Pub. Date: Dec. 29, 2016

(65) Prior Publication Data

US 2018/0184184 A1 Jun. 28, 2018

(30) Foreign Application Priority Data

Jun. 24, 2015 (CN) ..... 2015 1 0354365

(51) Int. Cl.
*H04R 9/06* (2006.01)
*H04R 1/02* (2006.01)
(Continued)

(52) U.S. Cl.
CPC ..... *H04R 1/025* (2013.01); *H04R 3/00* (2013.01); *H04R 9/06* (2013.01); *H04R 1/288* (2013.01);
(Continued)

(58) Field of Classification Search
CPC combination set(s) only.
See application file for complete search history.

(56) References Cited

U.S. PATENT DOCUMENTS 4,965,690 A * 10/1990 Tanaka ..... G11B 23/08785 242/347
8,515,113 B2 * 8/2013 Rothkopf ..... H04R 31/00 381/355
(Continued)

FOREIGN PATENT DOCUMENTS

CN 101940000 A 1/2011
CN 102724612 A 10/2012
(Continued)

OTHER PUBLICATIONS

Chinese Office Action issued in Chinese Patent Application No. 201510354365.9 dated Aug. 1, 2017.
(Continued)

*Primary Examiner* — Amir H Etesam
(74) *Attorney, Agent, or Firm* — Arent Fox, LLP

(57) ABSTRACT

Disclosed is a loudspeaker module, which comprises a loudspeaker unit and a module housing for accommodating the loudspeaker unit. The loudspeaker unit comprises a magnetic circuit assembly and a vibration assembly. The module housing comprises a polycarbonate plastic material layer and an elastomeric material layer having a compression amount. The polycarbonate plastic material layer forms an inner layer of the module housing. The elastomeric material layer is at least partially bonded on the outside of the polycarbonate plastic material layer to form the outer layer of the module housing. The polycarbonate plastic material layer and the elastomeric material layer are formed by double-shot injection molding. The loudspeaker module of the present disclosure can effectively solve the problem of the damage to the module housing caused by inflexible
(Continued)

contact with other components of the whole machine, and can utilize the outer layer structure to change the resonance frequency, thereby effectively ameliorating the resonance phenomenon of the module housing and optimizing the product performance.

8 Claims, 3 Drawing Sheets

(51) Int. Cl.

| | |
|---|---|
| ***H04R 3/00*** | (2006.01) |
| *H04R 1/28* | (2006.01) |
| *H04R 9/02* | (2006.01) |
| *H04R 31/00* | (2006.01) |

(52) U.S. Cl.
CPC ..... *H04R 9/025* (2013.01); *H04R 31/00* (2013.01); *H04R 2499/11* (2013.01); *H04R 2499/15* (2013.01)

(56) References Cited

U.S. PATENT DOCUMENTS

| | | | | |
|---|---|---|---|---|
| 2005/0152570 | A1 | 7/2005 | Yu et al. | |
| 2009/0041284 | A1* | 2/2009 | Tanaka | H04R 1/1016 381/370 |
| 2010/0264786 | A1* | 10/2010 | Cheng | H04M 1/0202 312/223.1 |
| 2010/0290660 | A1 | 11/2010 | Fukuda | |
| 2013/0251182 | A1 | 9/2013 | Yu et al. | |
| 2015/0358705 | A1 | 12/2015 | Chen et al. | |
| 2017/0339492 | A1* | 11/2017 | Ge | H04R 9/06 |

FOREIGN PATENT DOCUMENTS

| | | | |
|---|---|---|---|
| CN | 202710935 | U | 1/2013 |
| CN | 103118320 | A | 5/2013 |
| CN | 103618984 | A | 3/2014 |
| CN | 204046793 | U | 12/2014 |
| CN | 104980851 | A | 10/2015 |
| CN | 204741559 | U | 11/2015 |

OTHER PUBLICATIONS

International Search Report issued in Internation Patent Application No. PCT/CN2015/094517 dated Feb. 6, 2016.

Chinese Office Action issued in Chinese Application No. 201510354365.9 dated Feb. 13, 2018.

* cited by examiner

LOUDSPEAKER MODULE

CROSS REFERENCE TO RELATED APPLICATIONS

This application is a National Stage entry of International Application No.: PCT/CN2015/094517, filed on Nov. 13, 2015, which claims priority to Chinese Patent Application No. 201510354365.9, filed on Jun. 24, 2015. The disclosure of the priority applications are hereby incorporated in their entirety by reference.

TECHNICAL FIELD

The present disclosure relates to the field of electroacoustics, and particularly relates to a loudspeaker module.

BACKGROUND

Loudspeakers are device that can convert electric energy into sound energy. As the most basic sound producing unit, it is extensively used in terminal electronic devices such as mobile telephones, computers and PADs. When a loudspeaker is assembled with an electronic device, a peripheral housing is generally needed to accommodate the loudspeaker unit; that is, it is assembled with a terminal electronic device in the form of a loudspeaker module. Presently, PC (polycarbonate) is generally used as the material of the housing of loudspeaker modules, and PC may be added with 20% glass fiber to enhance the strength and high temperature resistance characteristic of the module housing.

During the assembling process of loudspeaker modules with whole electronic devices such as mobile telephones and tablet computers, close fitting or even interference fitting between loudspeaker modules and other components of mobile telephones often happens. Because PC is a hard material, such assembling between two hard parts will easily damage and thus deform the housing of loudspeaker module. In addition, as electronic products are increasingly thinner and smaller, and extremely small thickness design becomes the pursuit of mobile telephone industry, the gaps that are left between the components are very small. As the sizes of components have a certain tolerances themselves, zero gaps between the components in the assembling are not unusual. Accordingly, the housing of loudspeaker module is liable to be damaged due to stress deformation, and even the performance of the loudspeaker may be affected.

In the disclosure patent No. CN201310659401.3 published on Mar. 5, 2014, a module housing is provided with an elastic member structure that is integrally injection molded with the module housing, the elastic member combines with the end face of the open end of the front vocal cavity or the rear vocal cavity of the module housing, and the elastic member structure is preferably TPU (thermoplastic polyurethane elastomer), TPE (thermoplastic elastomer) or silica gel material. Such a design can effectively ensure the sealing between the sound producing hole of the module and the sound producing hole of the mobile telephone after the assembling of the module with the terminal is finished, and additionally, due to the presence of the elastic member, a certain elasticity can be guaranteed. However, in this technical solution, the elastic member merely combines with the end face of the open end of the vocal cavity of the module housing to mainly solve the problem of sealing of the sound producing hole, and the contact damage to the module housing in the assembling with the whole machine cannot be reduced significantly. Therefore, improvement must be made on the basis of this to avoid the above defect.

SUMMARY OF THE DISCLOSURE

An object of the present disclosure is to provide a loudspeaker module, in which the structure of the module housing is improved, so as to prevent the damage to the module housing during the assembling with the whole machine, and ameliorate the resonance phenomenon at the same time.

In order to achieve the above object, the present disclosure provides the following technical solution: a loudspeaker module, comprising a loudspeaker unit and a module housing accommodating the loudspeaker unit; the loudspeaker unit comprises a magnetic circuit assembly and a vibration assembly, wherein the module housing comprises a polycarbonate plastic material layer and an elastomeric material layer that has compression amount; the polycarbonate plastic material layer forms an inner layer of the module housing; at least a part of the elastomeric material layer combines with the outside of the polycarbonate plastic material layer, and forms an outer layer of the module housing; and the polycarbonate plastic material layer and the elastomeric material layer are formed by double-shot injection molding.

In a preferable embodiment, at least a part of the module housing is a composite structure of the polycarbonate plastic material layer and the elastomeric material layer.

In a preferable embodiment, the module housing comprises an upper module housing and a lower module housing that combines with the upper module housing; both the upper module housing and the lower module housing are composite structures that are formed by the polycarbonate plastic material layer and the elastomeric material layer by double-shot injection molding.

In a preferable embodiment, the elastomeric material layer is thermoplastic polyurethane elastomer or thermoplastic elastomer.

In a preferable embodiment, both the outer layer of the upper module housing and the outer layer of the lower module housing are the thermoplastic polyurethane elastomer material layer.

In a preferable embodiment, both the outer layer of the upper module housing and the outer layer of the lower module housing are the thermoplastic elastomer material layer.

In a preferable embodiment, the outer layer of the upper module housing is the thermoplastic polyurethane elastomer material layer, and the outer layer of the lower module housing is the thermoplastic elastomer material layer.

In a preferable embodiment, the outer layer of the upper module housing is the thermoplastic elastomer material layer, and the outer layer of the lower module housing is the thermoplastic polyurethane elastomer material layer.

In a preferable embodiment, the magnetic circuit assembly of the loudspeaker unit comprises a concentrating flux plate, a magnet that is fixed to the concentrating flux plate and a washer that covers a surface of the magnet; and the vibration assembly comprises a vibrating diaphragm and a voice coil that is adhesively fixed to the vibrating diaphragm.

In a preferable embodiment, the loudspeaker unit is electrically connected to an external circuit of the loudspeaker module by a FPCB board; the module housing is further provided with a leaking hole; and a damper is pasted on a surface of the leaking hole.

Compared with the prior art, in the loudspeaker module of the present disclosure, the module housing is a two-layer structure, the inner layer is made of traditional PC (polycarbonate) plastic material and can support the external shape, and the outer layer is made of materials that have a certain compression amount such as TPU and TPE, so that the outer layer of the module housing has a certain elasticity. Thus, during the assembling process with the whole machine, even if close fitting or interference fitting happens, the outer layer material can act as a cushion and reduce the damage to the inner PC layer. Thereby the problem of the damage to the module housing that is caused by the inflexible contact with other components can be effectively solved. On the other hand, in the present technical solution, the inner layer and the outer layer of the module housing are formed by double-shot injection molding process, and the outer layer structure can be used to change the resonance frequency, thereby effectively ameliorating the resonance phenomenon of the module housing. Moreover, in the loudspeaker module of the present disclosure, at least a part of the elastomeric material layers combine with the PC material layers, and may combine at the positions where the module housing contacts the components of the whole machine as required, thereby the problem of contact damage to the module housing during the assembling process with the terminal can be solved flexibly and targetedly.

Figure 1:
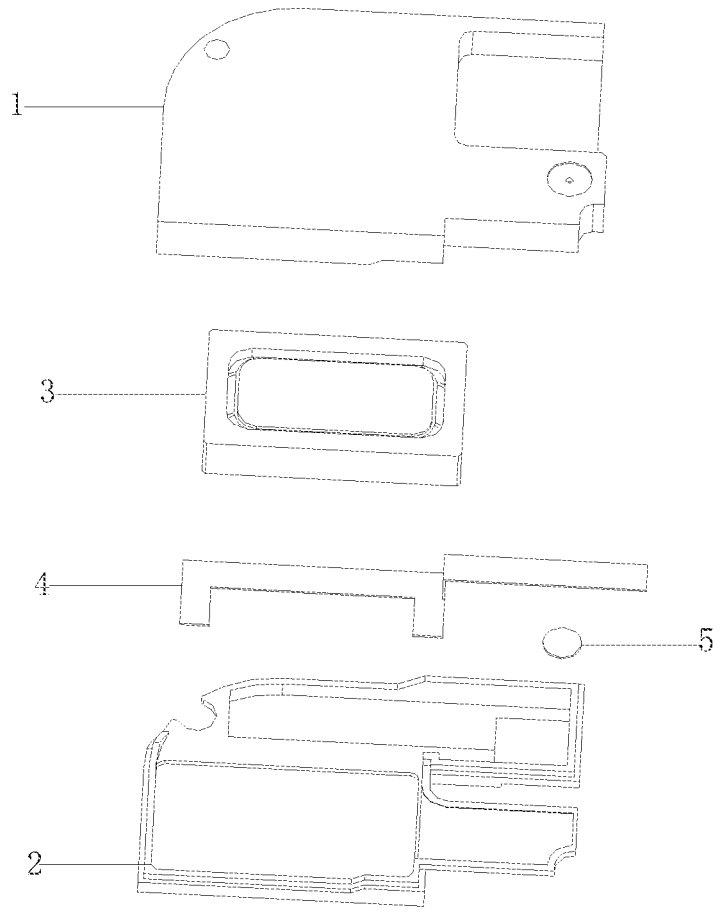
FIG. 1 is the exploded view of the structure of the loudspeaker module of the present disclosure.
Figure 2:
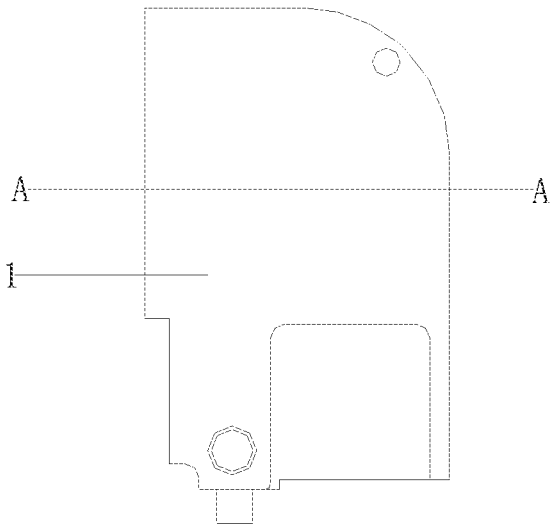
FIG. 2 is the top view of the structure of the loudspeaker module of the present disclosure.

wherein reference signs comprise: 1, upper module housing; 11, polycarbonate plastic material layer; 12, elastomeric material layer; 2, lower module housing; 21, polycarbonate plastic material layer; 22, elastomeric material layer; 3, loudspeaker unit; 4, FPCB board; 5, damper; 6, concentrating flux plate; 7, central magnet; 8, central washer; 9, side magnets; 10, side washers; 11, voice coil; 12, vibrating diaphragm; 13, front cover; and 14, shell.

DETAILED DESCRIPTION

The present disclosure will be described below in detail by referring to the drawings.

Embodiment

As shown in FIG. 1, FIG. 2, FIG. 5 and FIG. 6, the loudspeaker module of the present disclosure comprises a module housing and a loudspeaker unit 3 accommodated in the module housing. In the loudspeaker module according to the present embodiment, its module housing comprises an upper module housing 1 and a lower module housing 2, and the upper module housing 1 and the lower module housing 2 combine together to form a cavity accommodating the loudspeaker unit 3.

The loudspeaker unit 3 is the most basic sound producing unit, and comprises a magnetic circuit assembly and a vibration assembly. The magnetic circuit assembly comprises a concentrating flux plate 6, a central magnet 7 that is fixed to the surface of the concentrating flux plate 6, and a central washer 8 that covers the surface of the central magnet 7, and four side magnets 9 are provided around the periphery of the central magnet 7. Correspondingly, the surfaces of the side magnets 9 are covered by side washers 10 respectively. The vibration assembly comprises a vibrating diaphragm 12 and a voice coil 11 that is adhesively fixed to the vibrating diaphragm 12. Generally, in order to improve the high frequency performance of loudspeaker products, reinforcement layers are usually provided at the upper side or lower side of the middle position of the vibrating diaphragm 12. The magnetic circuit assembly and the vibration assembly are jointly accommodated in the cavity that is formed by a front cover 13 and a shell 14. The loudspeaker unit 3 is generally electrically connected to the external circuit of loudspeaker module by an electrical connector. In the present embodiment, the electrical connector is an FPCB board (flexible printed circuit board) 4. The FPCB board 4 is connected to the external circuit of module, and the loudspeaker unit 3 is connected to the FPCB board by a spring plate or a bonding pad structure. Therefore, the electric current signal of the external circuit passes through the electrically connecting structure and is finally transferred to the voice coil 11, and the voice coil 11 conducts the movement of reciprocatingly cutting the magnetic force lines under the force of the electromagnetic field, thereby drives the vibrating diaphragm 12 to vibrate and further radiate acoustic wave to the outside. Thereby the conversion from electric energy to sound energy is achieved. Generally, the module housing is further provided with a leaking hole that communicates with the external environment, and a damper 5 is pasted on the leaking hole.

Figure 3:
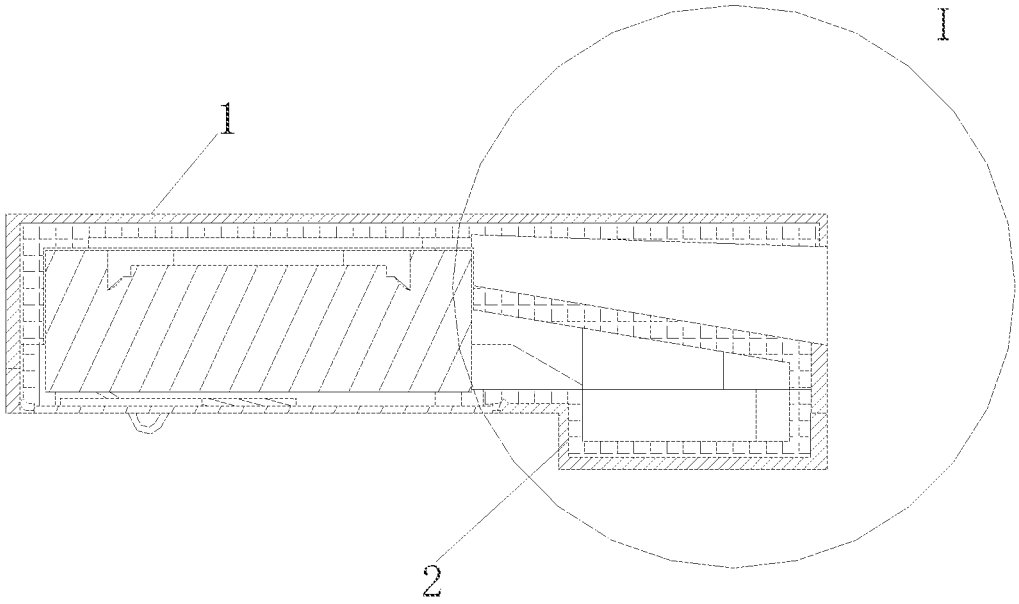
FIG. 3 is the sectional view of FIG. 2 along the line A-A.
Figure 4:
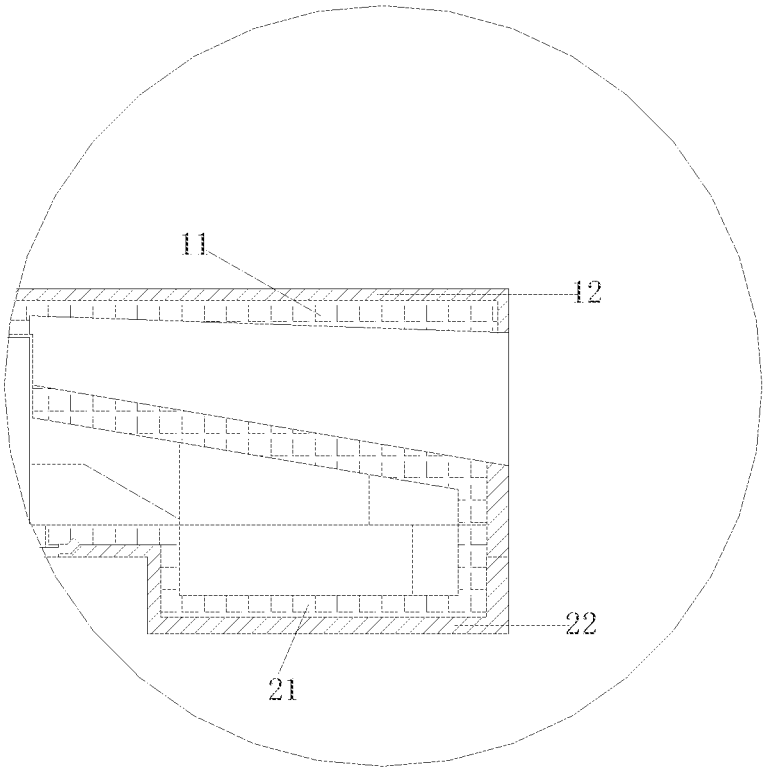
FIG. 4 is the enlarged view of the part I in FIG. 3.
Figure 5:
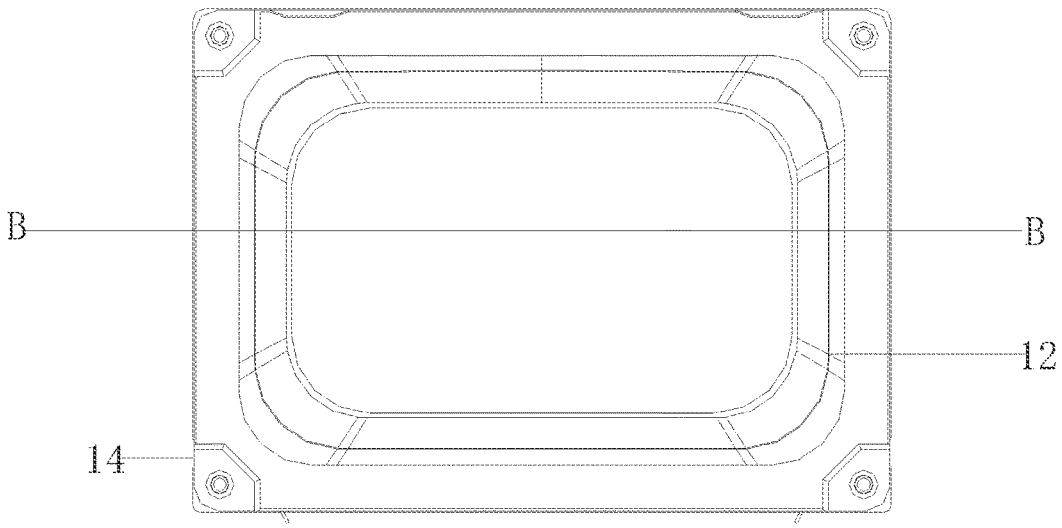
FIG. 5 is the top view of the structure of the loudspeaker unit of the loudspeaker module of the present disclosure.
Figure 6:
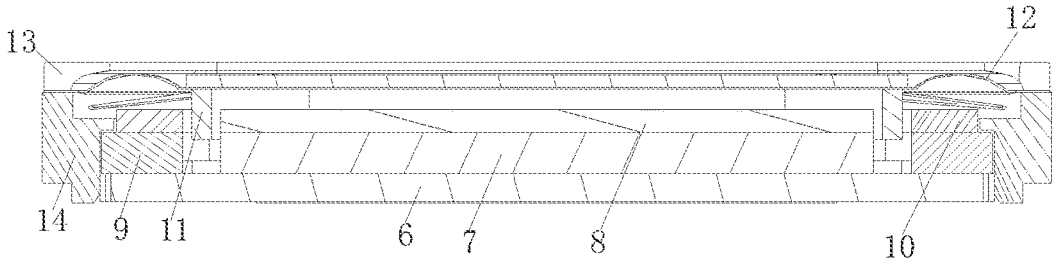
FIG. 6 is the sectional view of FIG. 5 along the line B-B.

As shown in FIG. 3 and FIG. 4, in the loudspeaker module of the present embodiment, its module housing (the upper module housing 1 and the lower module housing 2) comprises polycarbonate plastic material layers 11, 21 and elastomeric material layers 12, 22, the elastomeric material layers 12, 22 having a compression amount. It can be clearly seen in the figures that, the polycarbonate plastic material layers 11, 21 form the inner layers of the upper module housing 1 and the lower module housing 2 respectively to support the external shape of the module housing; the elastomeric material layers 12, 22 combine with the outside of the polycarbonate plastic material layers 11, 21 and form the outer layers of the upper module housing 1 and the lower module housing 2 respectively. Because the elastomeric material itself has a certain compression amount, the outer layer of the module housing has a certain elasticity, and thus during the assembling process with the whole machine, even if close fitting or interference fitting happens, the outer layer material can act as a cushion and reduce the damage to the inner layer. Thereby the problem of damage to the module housing that is caused by the inflexible contact with other components can be effectively solved.

In the present embodiment, the polycarbonate plastic material layers 11, 21 and the elastomeric material layers 12, 22 are integrally formed by double-shot injection molding process. More specially, the process comprises two steps: first, the inner layer material, that is, the polycarbonate plastic material layers 11, 21, is formed by the first shot injection molding, and because the material is hard, it can serve as the shaping frame for the outer layer material after molded; second, after the injection molding of the inner layer material is completed, the elastomeric material layers 12, 22 are formed by the second shot injection molding. The elastomeric material is relatively softer, and will easily deform without a support. Thereby the elastomeric material layers 12, 22 and the polycarbonate plastic material layers 11, 21 formed by the first shot injection molding are combined into an integral structure, and constitute the upper module housing 1 and the lower module housing 2 respectively. In the present embodiment, the inner layer and the outer layer of the module housing are formed by double-shot injection molding process, thereby the outer layer structure can be used to change the resonance frequency, and thus the resonance of the module housing can be effectively ameliorated.

It should be noted that, the present embodiment illustrates an example in which both the upper module housing 1 and the lower module housing 2 are formed by double-shot injection molding of the polycarbonate plastic material layers 11, 21 and the elastomeric material layers 12, 22, but in practice it is not limited to this way. The position where the elastomeric material and the polycarbonate plastic material combine can be designed as required. Generally, considering the object to be achieved by the present technical solution, the positions where the module housing contacts a component of the whole machine may be preferably chosen, thereby the effect of preventing the damage to the module housing can also be obtained. That is, in the present technical solution, at least a part of the elastomeric material layers combine with the polycarbonate plastic material layers, and at least a part of the module housing is the composite structure of these two layers.

In addition, it should be noted that, in the loudspeaker module according to the present embodiment, its module housing comprises two parts combined together, that is, the upper module housing 1 and the lower module housing 2, but the application of the present technical solution is not limited to such a module. It is also applicable to the structure that the module housing comprises three parts: an upper housing, a middle housing and a lower housing; that is, the upper housing, the middle housing and the lower housing may be partly a composite structure of the polycarbonate plastic material and the elastomeric material, and may also be totally a composite structure of these two materials. Moreover, in the loudspeaker unit 3 according to the present embodiment, its magnetic circuit assembly is a multi-magnetic-circuit structure, but the application of the present technical solution is not limited thereto, and is also applicable to a loudspeaker module that comprises a magnetic circuit assembly of a single-magnetic-circuit structure or a loudspeaker modules that comprises a magnetic circuit assembly of a double-magnetic-circuit structure (two side magnets); that is, the structure of the magnetic circuits does not constitute a limit to the present technical solution.

Preferably, the elastomeric material layers 12, 22 are thermoplastic polyurethane elastomer (TPU) or thermoplastic elastomer (TPE), and correspondingly, the upper module housing 1 and the lower module housing 2 may combine in the following four modes:

a. Both the outer layer of the upper module housing 1 and the outer layer of the lower module housing 2 are thermoplastic polyurethane elastomer material layers. That is, both of the module housings comprise two layers: an inner layer and an outer layer; both of the inner layers are polycarbonate plastic material layers, and both of the outer layers are thermoplastic polyurethane elastomer material layers.

b. Both the outer layer of the upper module housing 1 and the outer layer of the lower module housing 2 are thermoplastic elastomer material layers. That is, both of the module housings comprise two layers: an inner layer and an outer layer; both of the inner layers are polycarbonate plastic material layers, and both of the outer layers are thermoplastic elastomer material layers.

c. The outer layer of the upper module housing 1 is a thermoplastic polyurethane elastomer material layer, and the outer layer of the lower module housing 2 is a thermoplastic elastomer material layer. That is, the upper module housing 1 is the composite structure of the polycarbonate plastic material layer and the thermoplastic polyurethane elastomer material layer, and the lower module housing 2 is the composite structure of the polycarbonate plastic material layer and the thermoplastic elastomer material layer.

d. The outer layer of the upper module housing 1 is a thermoplastic elastomer material layer, and the outer layer of the lower module housing 2 is a thermoplastic polyurethane elastomer material layer. That is, the upper module housing 1 is the composite structure of the polycarbonate plastic material layer and the thermoplastic elastomer material layer, and the lower module housing 2 is the composite structure of the polycarbonate plastic material layer and the thermoplastic polyurethane elastomer material layer.

It should be noted that, the elastomeric material layers 12, 22 are not limited to the above two materials, and may be any other material that has similar characteristics, namely, has a certain compression amount itself, and can ensure a certain elasticity, and can be easily injection molded.

The description above is merely exemplary embodiments of the present disclosure, and not used to limit the present disclosure. Any equivalent modification or variation made by a person skilled in the art according to the disclosure of the present disclosure should fall within the protection scope defined by the claims.

What is claimed is:

1. A loudspeaker module, comprising a loudspeaker unit and a module housing accommodating the loudspeaker unit, and the loudspeaker unit comprises a magnetic circuit assembly and a vibration assembly, wherein the module housing comprises a polycarbonate plastic material layer and an elastomeric material layer, the elastomeric material layer having a compression amount;

the polycarbonate plastic material layer forms an inner layer of the module housing;

at least a part of the elastomeric material layer combines with the outside of the polycarbonate plastic material layer, and forms an outer layer of the module housing;

the polycarbonate plastic material layer and the elastomeric material layer are formed by double-shot injection molding, wherein the polycarbonate plastic material layer is formed by first shot injection molding, the elastomeric material layer is formed by second shot injection molding, and the elastomeric material layer and the polycarbonate plastic material layer are combined into an integral structure;

the module housing comprises an upper module housing and a lower module housing that combines with the upper module housing; and both the upper module housing and the lower module housing are composite structures that are formed by the polycarbonate plastic material layer and the elastomeric material layer by double-shot injection molding.

2. The loudspeaker module according to claim 1, wherein the elastomeric material layer is a thermoplastic polyurethane elastomer material layer or a thermoplastic elastomer material layer.

3. The loudspeaker module according to claim 2, wherein both the outer layer of the upper module housing and the outer layer of the lower module housing are the thermoplastic polyurethane elastomer material layer.

4. The loudspeaker module according to claim 2, wherein both the outer layer of the upper module housing and the outer layer of the lower module housing are the thermoplastic elastomer material layer.

5. The loudspeaker module according to claim 2, wherein the outer layer of the upper module housing is the thermoplastic polyurethane elastomer material layer, and the outer layer of the lower module housing is the thermoplastic elastomer material layer.

6. The loudspeaker module according to claim 2, wherein the outer layer of the upper module housing is the thermoplastic elastomer material layer, and the outer layer of the lower module housing is the thermoplastic polyurethane elastomer material layer.

7. The loudspeaker module according to claim 1, wherein the magnetic circuit assembly of the loudspeaker unit comprises a concentrating flux plate, a magnet that is fixed to the concentrating flux plate and a washer that covers the surface of the magnet; and the vibration assembly comprises a vibrating diaphragm and a voice coil that is adhesively fixed to the vibrating diaphragm.

8. The loudspeaker module according to claim 7, wherein the loudspeaker unit is electrically connected to an external circuit of the loudspeaker module by a FPCB board;

the module housing is further provided with a leaking hole; and a damper is pasted on the surface of the leaking hole.

* * * * *